US006857919B2

(12) United States Patent
Henmi et al.

(10) Patent No.: US 6,857,919 B2
(45) Date of Patent: Feb. 22, 2005

(54) IMPELLER FOR MARINE PROPULSION DEVICE

(75) Inventors: Yasuhiko Henmi, Shizuoka (JP); Tadatsugu Yamamura, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/957,447

(22) Filed: Sep. 19, 2001

(65) Prior Publication Data

US 2004/0009718 A1 Jan. 15, 2004

(30) Foreign Application Priority Data

Sep. 19, 2000 (JP) ..... 2000-283494

(51) Int. Cl.[7] ..... B63H 11/00
(52) U.S. Cl. ..... 440/38; 416/231 R; 440/47
(58) Field of Search ..... 440/38, 47; 416/231 R, 416/236 R

(56) References Cited

U.S. PATENT DOCUMENTS

| | | | | | |
|---|---|---|---|---|---|
| 241,124 | A | * | 5/1881 | Deane | 416/231 R |
| 1,717,745 | A | * | 6/1929 | Friedrich | 416/228 |
| 4,971,584 | A | | 11/1990 | Inoue et al. | |
| 5,108,257 | A | | 4/1992 | Fukazawa et al. | |
| 5,192,191 | A | | 3/1993 | Tasaki | |
| 5,266,009 | A | | 11/1993 | Tasaki et al. | |
| 5,827,096 | A | | 10/1998 | Mineo | |
| 5,984,740 | A | * | 11/1999 | Ikeda et al. | 440/38 |
| 6,354,804 | B1 | * | 3/2002 | Leung | 416/231 R |

OTHER PUBLICATIONS

W.E. Nelson, P.E., Understanding Pump Cavitation, Feb. 1, 1997, published on the internet under http://www.osmonic-s.com/products/.

Author Unknown, Cavitation for the Technologically Challenged, date unknown, published on the internet under http://www.buckeyepumps.com/Cavitation.html.

Author Unknown, Cavitation 1–3, date unknown, published on the Internet under http://www.mcnallyinstitute.com/01–html/1–3.html.

Author Unknown, A Little Bit More About Cavitation 9–10, date unknown, published on the Internet under http://www.mcnallyinstitute.com/09–html/9–10.html.

Co–pending patent application: U.S. Appl. No. 09/280,129, filed Mar. 26, 1999, entitled Induction System for Watercraft Engine, in the name of Ito et al., and assigned to Yamaha Hatsudoki Kabushiki Kaisha.

* cited by examiner

*Primary Examiner*—Jesus D. Sotelo
(74) *Attorney, Agent, or Firm*—Knobbe Martens Olson & Bear, LLP

(57) ABSTRACT

An impeller for a jet propulsion device includes at least one fluid channel formed on each impeller blade. During impeller rotation, a fluid back-flow is generated through the fluid channels. The back-flow advantageously sweeps cavitation bubbles away from the impeller blades and inhibit their implosion on the blade surfaces and/or inner housing surface which lies adjacent the blade tips. This desirably reduces erosion and provides a long-life and efficient propulsion device.

86 Claims, 9 Drawing Sheets

IMPELLER FOR MARINE PROPULSION DEVICE

RELATED APPLICATIONS

This application claims priority to Japanese Application No. 2000-283494, filed Sep. 19, 2000, the entire disclosure of which is hereby incorporated by reference herein.

BACKGROUND OF THE INVENTION

1. Field of the Invention

The invention relates in general to a watercraft, and in particular to a marine jet propulsion system for a watercraft, and more particularly to an impeller for a jet propulsion device.

2. Description of the Related Art

Personal watercraft have become increasingly popular in recent years. Jet propulsion devices commonly power these type of watercraft and include a motor driven impeller. The impeller operates within a water duct of the jet propulsion device. The rotating impeller draws in water through a water intake opening on the underside of the watercraft's hull and into the intake duct. The impeller forces the water through a discharge nozzle to form a jet of water. This water jet propels the watercraft.

One problem particular to impeller constructions is that, due to a variety of reasons, cavitation or precipitation of gaseous bubbles or vapor can occur. One reason cavitation may occur is due to the pressure variations attendant to the actual rotation of the impeller. These vapors or bubbles can then implode on the impeller surface, thereby possibly causing impeller erosion. Disadvantageously, this can affect performance and shorten the life of the impeller.

SUMMARY OF THE INVENTION

The present impeller overcomes some or all of the above limitations by providing a fluid channel on one or more of the impeller blades. During impeller rotation, a back-flow is generated through the fluid channels. Advantageously, the back-flow sweeps cavitation bubbles away from the impeller blades and inhibits their implosion on the blade surfaces. This desirably reduces erosion and provides a long-life and efficient system.

In accordance with one aspect of the invention, an impeller for a marine propulsion device is provided to draw in fluid and discharge it as a jet to create a propulsion force. The impeller comprises a generally central hub and at least one blade that is connected to the hub (either by mechanically means or by being formed unitarily with the hub). The hub has a generally central axis and is adapted to rotate about the axis. The blade extends generally outwardly from the hub. The blade comprises a leading surface facing generally upstream, a trailing surface facing generally downstream and an outer rim. At least one groove is formed at a predetermined position on the outer rim of the blade to allow fluid to back-flow from downstream to upstream. The back-flow inhibits cavitation induced bubbles from imploding on the leading surface of the blade to reduce erosion thereon.

In accordance with another aspect of the invention, an impeller for a watercraft is provided to create a jet of water to propel the watercraft. The impeller comprises a boss portion and at least one blade connected to the boss portion (either by mechanically means or by being formed unitarily with the hub). The boss portion is rotatable about a generally central axis of the impeller. The blade extends generally outwardly from the boss portion. The blade comprises an upstream side and a downstream side. At least one through hole is provided on the blade between the upstream side and the downstream side for permitting high pressure water from the downstream side to flow through the hole towards low pressure water on the upstream side for sweeping water vapor away from the upstream side to reduce cavitation induced erosion thereon.

In accordance with an additional aspect of the invention, an impeller for a marine propulsion device is provided. The impeller comprises a hub, at least one blade to draw in fluid and discharge it to generate a propulsion force. The impeller additionally comprises means on the blade for generating a back-flow. The hub is rotatable about a generally central axis. The blade is connected to the hub and comprises a leading surface facing generally upstream and a trailing surface facing generally downstream. The back-flow is generated from downstream to upstream. The back-flow inhibits cavitation induced bubbles from collapsing on the leading surface of the blade to reduce erosion thereon.

In accordance with still another embodiment, a rotatable impeller for a marine propulsion device is provided. The impeller comprises a generally central hub, at least one blade extending generally outwards from the hub and at least one fluid channel on the blade. The blade comprises a front surface and a back surface. The fluid channel allow back-flow driven by a pressure differential between the blade front surface and the blade back surface for reducing cavitation induced erosion. In one mode, the channel can be a groove, slit, or depression formed at a rim of the blade, and in an additional mode the channel can be an opening or passage that allows for the back-flow of water. Thus, as used herein, "channel" means a course through which a fluid (liquid or gas) can flow from a back side of the blade to a front side of the blade.

For purposes of summarizing the invention, certain aspects, advantages and novel features of the invention have been described herein above. Of course, it is to be understood that not necessarily all advantages disclosed or taught herein may be achieved in accordance with any particular embodiment of the invention. Thus, the invention may be embodied or carried out in a manner that achieves or optimizes one advantage or group of advantages as disclosed or taught herein without necessarily achieving other advantages as may be disclosed, taught or suggested herein.

All of these aspects are intended to be within the scope of the invention herein disclosed. These aspects of the invention, as well as others, will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

With having summarized the general nature of the invention and some of its features and advantages, certain preferred embodiments and modifications thereof will become apparent to those skilled in the art from the detailed description herein having reference to the figures that follow, of which.

DETAILED DESCRIPTION OF THE PREFERRED EMBODIMENTS OF THE INVENTION

Figure 1:
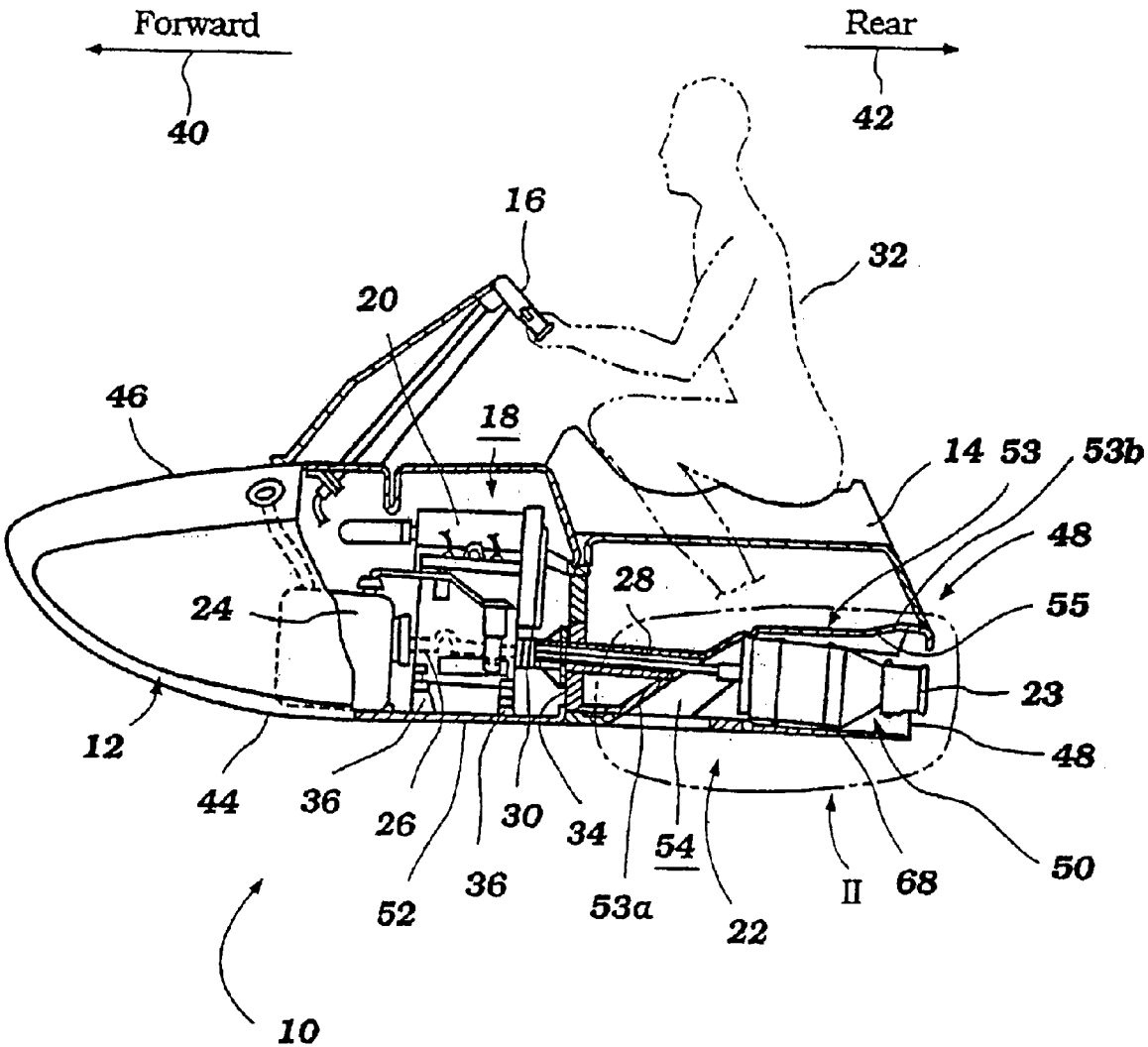
FIG. 1 is a side elevational view of a watercraft with a portion broken away and shown in partial section in order to depict a jet propulsion device configured in accordance with one preferred embodiment of the invention.

The present impeller and propulsion device has particular utility for use with personal watercraft, and thus, the following describes these in the context of a personal watercraft. This environment of use, however, is merely exemplary. The present impeller and propulsion device can be readily adapted by those skilled in the art for use with other types of watercraft as well, such as, for example, but without limitation, small jet boats and the like.

With initial reference to FIG. 1, a watercraft or water jet propelled boat 10 comprises a hull 12, a seat 14, a steering operator 16, an engine compartment 18, an engine 20 which is mounted inside the engine compartment 18, and a propulsion device 22, which will be described in detail below. A steering nozzle 23 disposed on the end of the propulsion device 22 to control the direction of the water jet exiting the propulsion device 22. The watercraft 10 further comprises a fuel tank 24 mounted in the engine compartment 18 for supplying fuel to the engine 20. A forward direction is generally depicted by arrow 40 and a rearward direction by arrow 42.

The hull 12 (FIG. 1) is formed of a suitable material such as, for example, a molded fiberglass reinforced resin, and can be made of any of a wide variety of methods. For instance, the hull 12 can be formed using a sheet molding compound (SMC), that is, a mixed mass of reinforced fiber and thermal setting resin, that is processed in a pressurized, closed mold. Portions or the entire hull can also be formed of other material, such as, for example, plastics.

The hull 12 (FIG. 1) comprises a lower hull section 44 and an upper deck section 46. In the illustrated embodiment of FIG. 1, the lower section 44 and the upper section 46 are formed separately and then are fixed together around their peripheral edges in any suitable manner. For instance, these hull sections can nest together and be bonded and/or riveted. In addition, both the lower hull section 44 and the upper deck section 46 can be formed by multiple pieces. For example, the lower hull section 44 can include one or more inserts that are fit within an outer hull shell. Similarly, the upper deck section can include a number of components that are either adhered or fastened together.

The hull 12 (FIG. 1) may be configured to define a pair of raised gunnels (not shown) positioned on opposite sides of the watercraft 10. These raised gunnels can define a pair of foot areas (not shown) that generally extend longitudinally and parallel to the sides of the watercraft 10. In this position, the operator and any passengers sitting on the watercraft 10 can place their feet in the foot areas with the raised gunnels shielding the feet and lower legs of the riders. A non-slick, for example, rubber, mat desirably covers the foot areas to provide increased grip and traction for the operator and the passengers.

The seat 14 (FIG. 1) is provided on the hull 12 to accommodate a rider or operator 32 (shown in phantom in FIG. 1) seated in straddle fashion. Though only one rider 32 is shown in FIG. 1, the skilled artisan will appreciate that the seat 14 and watercraft 10 may efficaciously be configured to accommodate more than one rider (for example up to four passengers).

In the illustrated embodiment of FIG. 1, the steering operator 16 is a handlebar assembly for steering and other control of the watercraft 10. However, other steering operators, such as, for example, a steering wheel, control stick (that is, joystick) and the like can be utilized with efficacy. The steering operator 16 operates a steering actuator (not shown) to control the steering nozzle 23 and to effect the desired movement of the watercraft 10.

The engine compartment 18 (FIG. 1) within the hull 12 is generally defined as forward of a bulkhead 34; however, the hull 12 in many personal watercraft and jet boats (as well as in other applications) need not include a bulkhead. In such modes, the engine compartment 18 can be defined at least in part at a location forward of a wall that defines an inlet duct of the propulsion device 22. The engine compartment also can lie, at least in part, above the inlet duct and/or a propulsion unit of the propulsion device 22. Except for a conventional ventilation system, which includes a plurality of air ducts, the engine compartment 18 is normally sealed so as to enclose the engine 20 and the fuel tank or system 22 of the watercraft 10 from the body of water in which the watercraft 10 is operated.

The engine 20 (FIG. 1) powers the propulsion device 22 and includes a crankshaft 26. The crankshaft 26 is journaled for rotation about a generally longitudinally extending axis and drives a coupling 30. An impeller or drive shaft 28, which is journaled for rotation, extends forwardly from the propulsion device 22 and is connected to the coupling 30. The propulsion device 22 (including the impeller shaft 28), the engine 20 and other associated interconnecting components comprise a jet propulsion system of the watercraft 10.

In the illustrated embodiment of FIG. 1, the coupling 30 directly transfers rotational movement of the crankshaft 26 to the impeller shaft 28, such that the shafts 26, 28 rotate together at substantially the same rotational speed. That is, the crankshaft 26 is an output shaft of the engine 20 and directly drives the impeller shaft 28. However, the engine 20 can include a drive mechanism (not shown) that interconnects the crankshaft 26 to an output shaft of the engine 20. Such a drive mechanism in some applications can reduce the rotational speed (that is, step down the speed) of the output shaft relative to the crankshaft 26.

The engine 20 (FIG. 1) is preferably an internal combustion engine and drives the impeller shaft 28 to power the jet propulsion device 22. The engine 20 is positioned within the engine compartment 18 and is mounted substantially centrally within the hull 12 (at least as viewed side to side). Vibration-absorbing engine mounts 36 secure the engine 20 to the lower hull section 44.

In the illustrated embodiment of FIG. 1, the engine 20 is a two cylinder in-line crankcase compression, two cycle type. An induction system (not shown) produces a fuel charge which is delivered to the cylinders in a known manner. Other known types of engines, such as, for example, those including three or four in-line cylinders positioned such that the row of cylinders lies parallel to a longitudinal axis of the watercraft, running bow to stem, operating on either a two or four stroke principle may be efficaciously used, as needed or desired. The skilled artisan will readily appreciate that the present propulsion system can include any of a variety of engine types having other numbers of cylinders, having other cylinder arrangements, and operating on other combustion principles.

Figure 2:
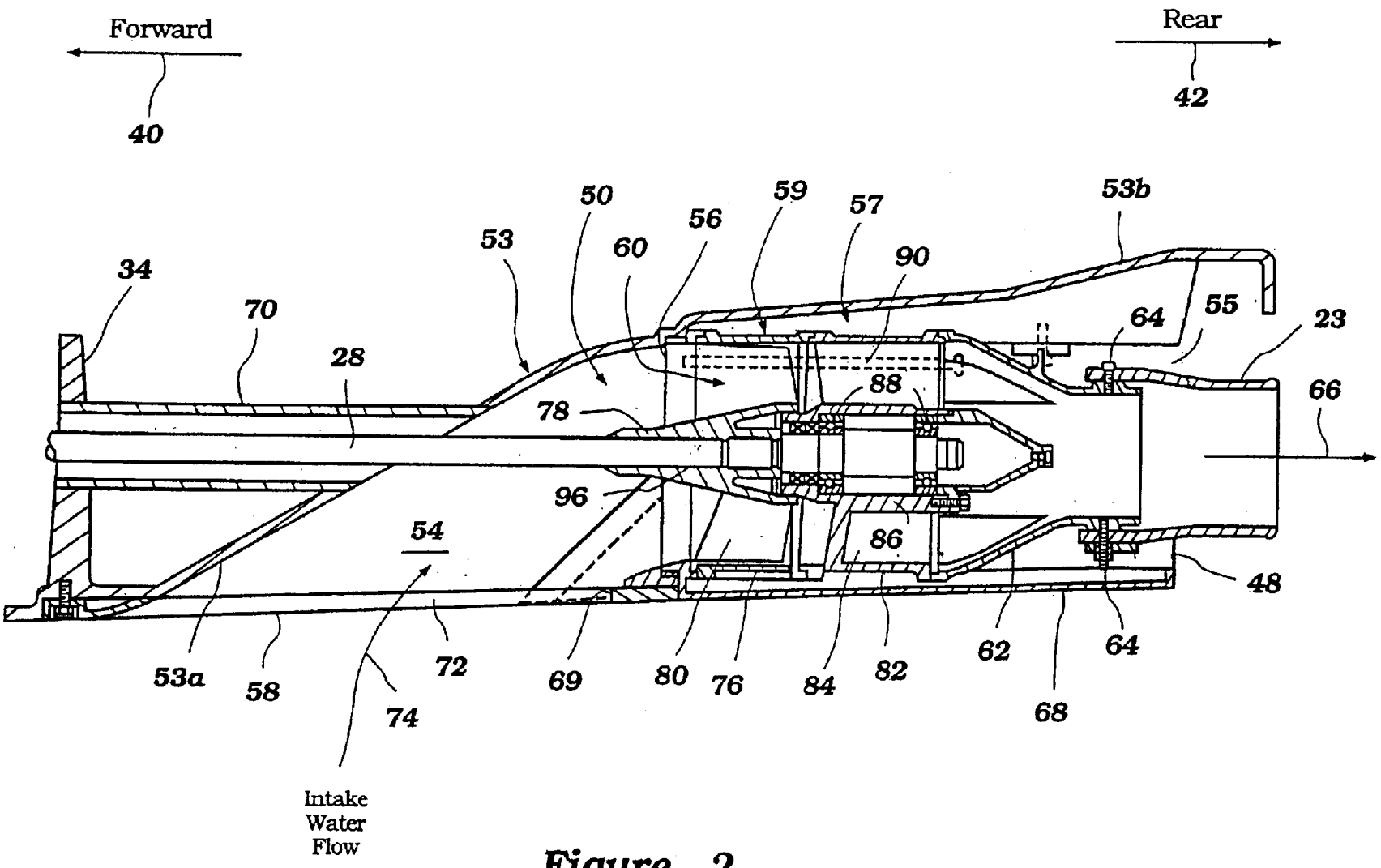
FIG. 2 is an enlarged sectional view of the jet propulsion device of FIG. 1.
Figure 3:
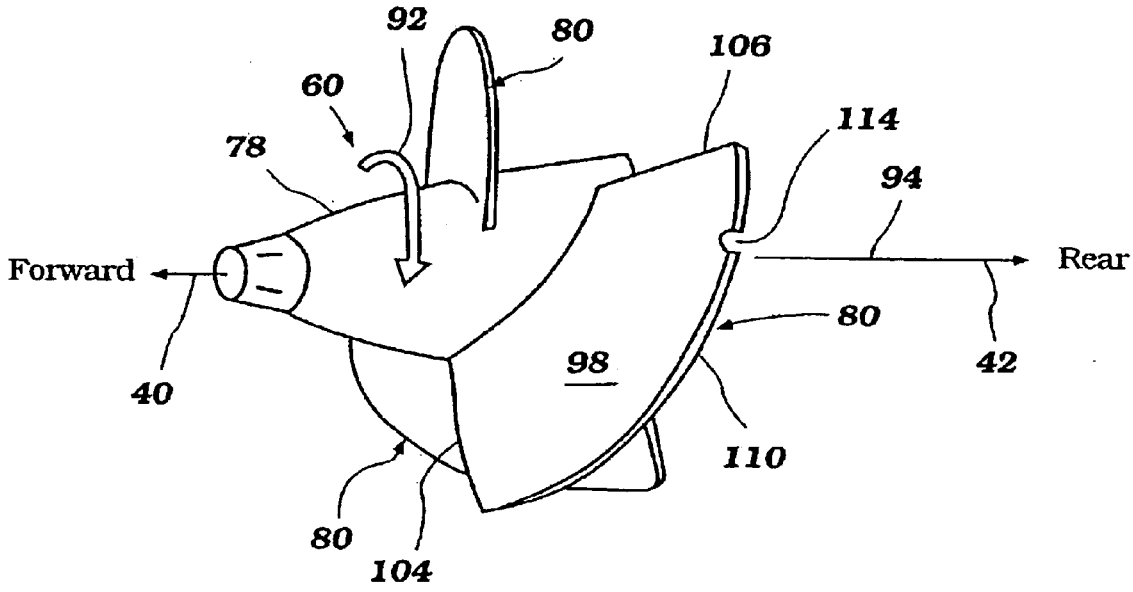
FIG. 3 is a perspective view of an impeller of the jet propulsion device of FIG. 2 configured in accordance with one preferred embodiment of the invention.

With reference to FIGS. 1 and 2, towards a transom 48 of the watercraft 10, the lower hull section 44 includes an outwardly extending recessed channel or tunnel 50. The tunnel 50 is formed centrally in the underside of a hull keel section 52 rearward of the engine compartment 20. In the illustrated embodiment, the tunnel 50 is defined on the underside of the lower hull section 44 by a tunnel piece 51. In the illustrated embodiment the tunnel piece 51 is part of the lower hull section 44, but it is separate from the portion of the hull that defines the keel section 52. While the tunnel piece 53 is formed separate from the portion of the hull that defines the keel section 52, it is understood that these sections of the lower hull section 44 can be formed unitarily.

The tunnel piece 53 includes a front duct section 53*a* and a rear section 53*b*. The front duct section 53*a* defines an intake or inlet duct 54 of the jet propulsion device 22. The inlet duct 54 opens rearward into an enlarged rear section 55 of the tunnel that is defined by the rear duct section 53*b*. The rear section 55 of the tunnel 50 has generally parallelepiped shape and opens through the rear of the transom 48. As best seen in FIG. 2, the rear section 55 of the tunnel 50 terminates at its front end in a front wall 56, which in the illustrated embodiment, lies behind the bulkhead 34. The bulkhead 34 in this embodiment thus separates a hull compartment above the tunnel 50 from the engine compartment 18.

A propulsion unit 57 of the jet propulsion device 22 (FIGS. 1 and 2) is mounted within the rear section 55 of the tunnel 50 by a plurality of bolts, threaded fasteners or the like (not shown). The intake duct 54, which as noted above is formed in part by the tunnel duct section 53*a*, defines an inlet port 58 on the underside of the lower hull section 44.

In the illustrated embodiment, the intake duct 54 is formed apart from the propulsion unit 57. In other embodiments, the intake duct 54 can be integrally formed as part of the propulsion unit 57, rather than be part of the hull. For this reason, the intake duct 54 is considered part of the jet propulsion device 22.

The inlet duct 54 (FIGS. 1 and 2) leads to an impeller housing 59 of the propulsion unit 57 in which a specially designed impeller 60, as described in detail below, of the jet propulsion device 22 operates. The impeller housing 59 also acts as a pressurization chamber and delivers the water flow from the impeller 60 to a discharge nozzle 62. In the illustrated embodiment of FIGS. 1 and 2, an inlet grate 72 is positioned over the opening 56 of the duct 54 for screen large foreign articles from the incoming water flow, as generally designated by arrow 74 in FIG. 2.

The impeller shaft 28 (FIGS. 1 and 2) extends forward of the jet propulsion unit 57 through a cylindrical casing 70 that is preferably integrally formed with the inlet duct wall 53*b*, although it need not be. The impeller shaft 28 extends through the bulkhead 34 and is desirably supported thereon by a rubber bearing/seal assembly (not shown). This assembly includes grease-backed seals to inhibit water from the intake duct 54 from entering the engine compartment 18. In other embodiments, the casing 70 need not be as long as shown, extend through a bulkhead, or be integral with the inlet duct wall 53*b*.

The steering nozzle 23 (FIGS. 1 and 2) is supported at the downstream end of the discharge nozzle 62 by a pair of vertically extending pivot pins or bolts 64, as best seen in FIG. 2. In the exemplary embodiment, the steering nozzle 23 includes a lever (not shown) on one side which is moved by an actuator (for example, a bowden-wire cable) that is controlled by the steering operator 16. In this manner, steering movement is effected by movement of the operator 16. A water jet exits the steering nozzle 23 to propel the watercraft 10.

A ride or closure plate 68 (FIGS. 1 and 2) covers the rear section 55 of the tunnel 50 to enclose the propulsion unit 57 within the tunnel 50. In this manner, the lower opening of the tunnel 50 is closed to provide in part a planing surface for the watercraft 10. The ride plate 54 desirably include a generally straight, horizontally extending central section which is at least parallel to the keel 52 of the hull lower section 44. This section can be flat or can include inclined sides. A front end of the ride plate 68 or a shoe piece 69 disposed in front of the ride plate desirably defines a rear edge of the inlet opening 58.

With reference to FIG. 2 in more detail now, the jet propulsion device 22 comprises the outer housing or casing 59 which terminates in the discharge nozzle 62 and has an impeller section 76 containing within it the rotatable impeller 60. As described further below, the impeller 60 comprises a central hub or boss portion 78 and one or more blades or fins 80 which radiate generally outwardly from the hub 78.

In the illustrated embodiment of FIG. 2, the housing 58 further comprises a stator section 82 downstream of the impeller section 76 and positioned between the impeller section 76 and the discharge nozzle 62. The stator section 82 houses one or more stationary blades, vanes, fins or wings 84 (i.e., stators) for straightening the water flow emanating from the impeller section 76 towards the discharge nozzle 62.

The impeller hub portion 78 (FIG. 2) is connected to the impeller shaft 34 for rotatably driving the impeller 60 and drawing water through the inlet duct 54 for discharge into the stator section 82 wherein the straightening vanes 84 are supported. After being straightened, the water is discharged through the discharge nozzle 62 and steering nozzle 23.

As shown in FIG. 2, the stator section 82 is formed with an internal hub part that supports a bearing assembly 86 for journaling the rear end of the impeller shaft 28. The bearing includes a pair of antifriction bearings 88 which suitably journal the impeller shaft 28 for rotation. In another embodiment, the propulsion unit 57 can be configured in accordance with the disclosure of U.S. Pat. No. 4,541,808, which is hereby incorporated by reference.

In the illustrated embodiment of FIG. 2, the outer housing or casing 59 comprises the impeller section 76, the straightening section 82 and the discharge nozzle 62 which are held together by means of elongated bolts or rods 90. A sleeve may be fitted within the housing 58. The housing sections 76, 82, 62 can have tongue- and groove-like joints at their mating edges to insure adequate sealing. In another embodiment, the outer housing 58 comprises an integrally formed casing body in which a sleeve is fitted. The housing 58, as discussed below, preferably includes a wear ring disposed around the impeller blades 60.

The housing 58 (FIG. 2) has a generally cylindrical fluid passage which tapers to a smaller diameter at the discharge nozzle 62. The housing 58 can be formed from any of a number of suitably strong and durable materials, such as, for example, metals, alloys, plastics and ceramics, by any of a number of manufacturing techniques, such as, for example, machining, casting, molding and forging. In the exemplary embodiment, the housing 58 comprises a stainless steel sleeve fitted into a casing body which is made of an aluminum alloy.

FIGS. 3 to 6 show in more detail several different views of the impeller 60 configured in accordance with one preferred embodiment of the invention. The impeller 60 comprises the hub or boss portion 78 from which at least one and preferably a plurality of blades 80 radiate or extend generally radially outwards. As discussed in detail below, the present impeller is specially configured to prevent cavitation induced bubbles from imploding on the blades, thereby providing an anti-erosion mechanism.

In the exemplary embodiment, the impeller 60 is a cast product of stainless steel or an aluminum alloy and comprises an integral unit. Of course, as the skilled artisan will recognize, the impeller 60 can be formed from any of a number of other suitably strong and durable materials, such as, for example, other metals, alloys, plastics and ceramics, by any of a number of other manufacturing techniques, such as, for example, machining, molding and forging.

The impeller 60 (FIGS. 3–6) has a direction of rotation, generally depicted by arrow(s) 92, about a generally central rotation axis 94 of the impeller 60, hub 78 and blades 80. In the illustrated embodiment of FIGS. 3 to 6, this rotation direction 92 is shown as clockwise. Of course, as the skilled artisan will appreciate, the present impeller can efficaciously be configured to rotate in a counter-clockwise direction, as needed or desired.

The hub 78 (FIGS. 3–6) is a generally central portion of the impeller 60. The hub 78 has a generally central cavity 96 for receiving the impeller shaft 28, as best seen in FIG. 2. The hub 78 may be configured in a variety of manners, as known in the art. In the exemplary embodiment, the outer peripheral surface of the hub 78 is generally frusto-conical or cylindrical with portions having a varying or fixed outer diameter.

In the illustrated embodiment of FIGS. 3 to 6, each impeller blade 80 extends radially outwards from the hub 78 and also extends rearwardly. Each blade 80 has a front face, surface or side 98 and a rear face, surface or side 100 with both extending radially outwards and also extending rearwardly.

The rotation of the impeller 60 (FIGS. 3 to 6) creates a pressure differential between the faces 98, 100 with the front face 98 exposed to a low water pressure and the rear face 100 exposed to a high water pressure. This pressure differential draws a stream of water 102 (see FIG. 6) through the impeller 60 and generates a propulsion force or thrust to propel the watercraft 10 (FIG. 1). In FIG. 6, an upstream flow is schematically represented by arrows 102*u* and a downstream flow is schematically represented by arrows 102*d*. It should be noted that the arrows 102*u* and 102*d* do not necessarily represent a local flow direction but are intended to show a "global" or "bulk" direction of water flow through the impeller. The front face 98 is also referred to as a leading, upstream or low pressure face (surface, side) and the rear face 100 is also referred to as a trailing, downstream or high pressure face (surface, side).

Each blade 80 (FIGS. 3–6) has a front or leading rim 104 and a rear or trailing rim 106 with both extending radially from the hub 78. Each front rim 104 leads each respective rear rim 106 in the rotation direction 92. Relative to the axis 94, each front rim 104 is positioned at generally the forward-most portion of each respective blade 80 while each rear rim 106 is positioned at generally the rear-most portion of each respective blade 80. As best seen in the front view of FIG. 4, the blades 80 are arranged such that the front rim 104 of one blade 80 leads, as illustrated by arrow 108, the rear rim 106 of an adjacent blade 80 relative to the rotation direction 92 so that there is a partial overlap between adjacent blades.

Each blade 80 (FIGS. 3–6) has an outer rim or tip 110 which connects each respective front rim 104 and each respective rear rim 106. Each outer rim 110 is generally arcuate in shape or shaped in the form of an arc of a circle so that when the impeller 60 is viewed from the front (see FIG. 4) a generally circular shape is observed. Stated differently, the projection of the impeller 60 on an imaginary plane 112 (see FIG. 6) substantially perpendicular to the impeller axis 94 has a generally circular perimeter.

In the illustrated embodiment of FIGS. 3–6, the impeller 60 comprises three rotatable blades, fins, vanes or wings 60. In modified embodiments, the present impeller may be configured with fewer or more blades with efficacy, as needed or desired. For example, one, two, four or more blades may be used.

In the illustrated embodiment of FIGS. 3 to 6, a groove, niche or recess 114 is provided at a predetermined position on each blade outer rim 110. As discussed in further detail below, and as best illustrated in FIG. 6, the groove 114 provides a fluid channel for water back-flow 116 from the blade rear (high pressure) face 100 to the blade front (low pressure) face 98 so that cavitation bubbles are swept away from the front face 98. In this manner, the cavitation bubbles or vapors are inhibited from impacting the front face 98 and erosion of the blade 60 is prevented or mitigated.

The optimal configuration and location of the groove 114 can be determined by a number of ways. For the exemplary embodiment, extensive laboratory testing was performed under actual cruising conditions. The laboratory data can also be used to generate correlations or look-up tables using varying impeller configurations, such as, for example, varying blade sizes and geometries, so that optimum groove configurations and locations can be readily determined. Alternatively, or in addition, fluid mechanical techniques, such as, for example, computational fluid dynamics modeling, may be used to determine optimized groove configurations and locations.

Figure 4:
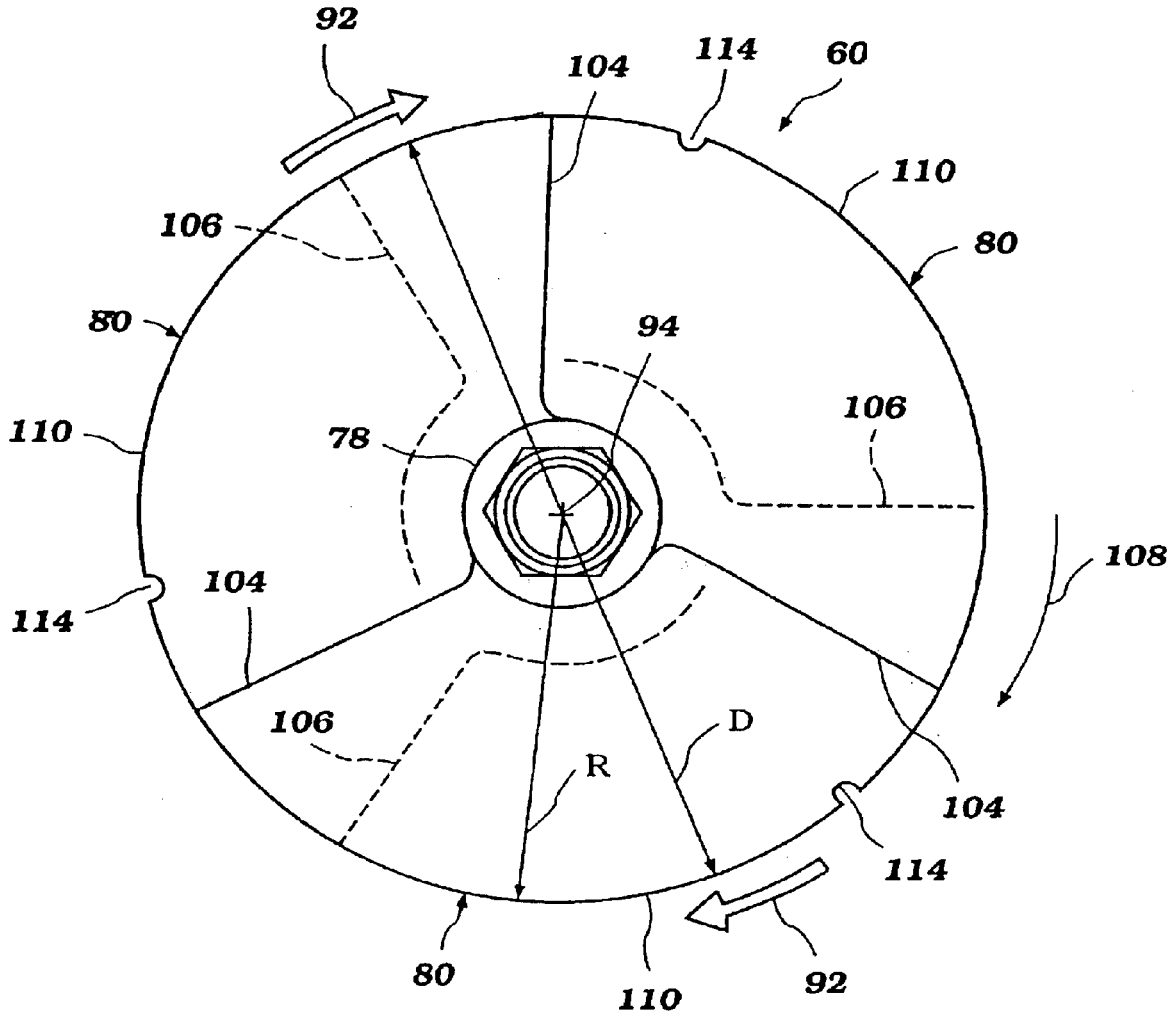
FIG. 4 is a front elevational view of the impeller of FIG. 3.
Figure 5:
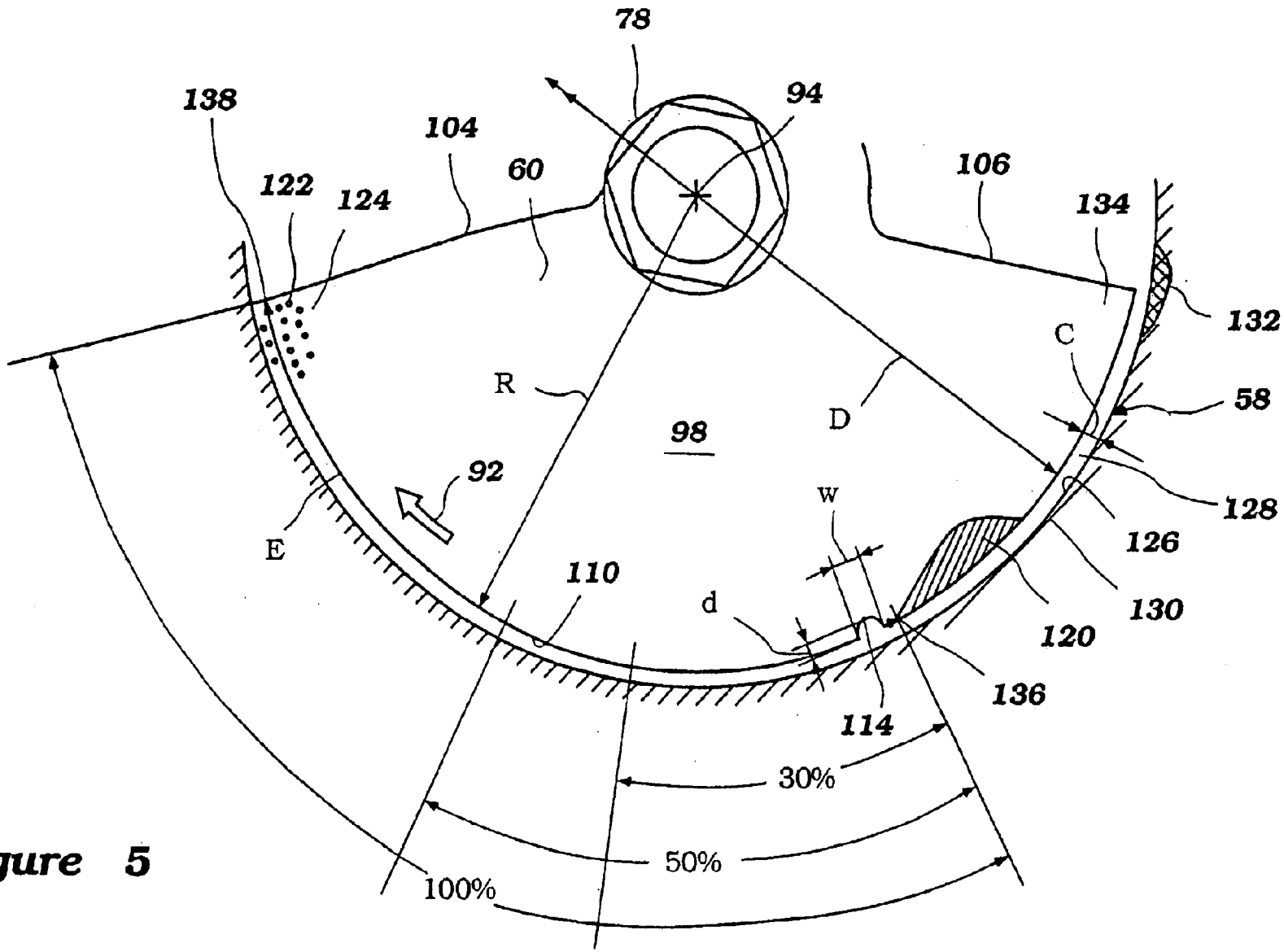
FIG. 5 is an enlarged front elevational partial view of the impeller of FIG. 3.
Figure 6:
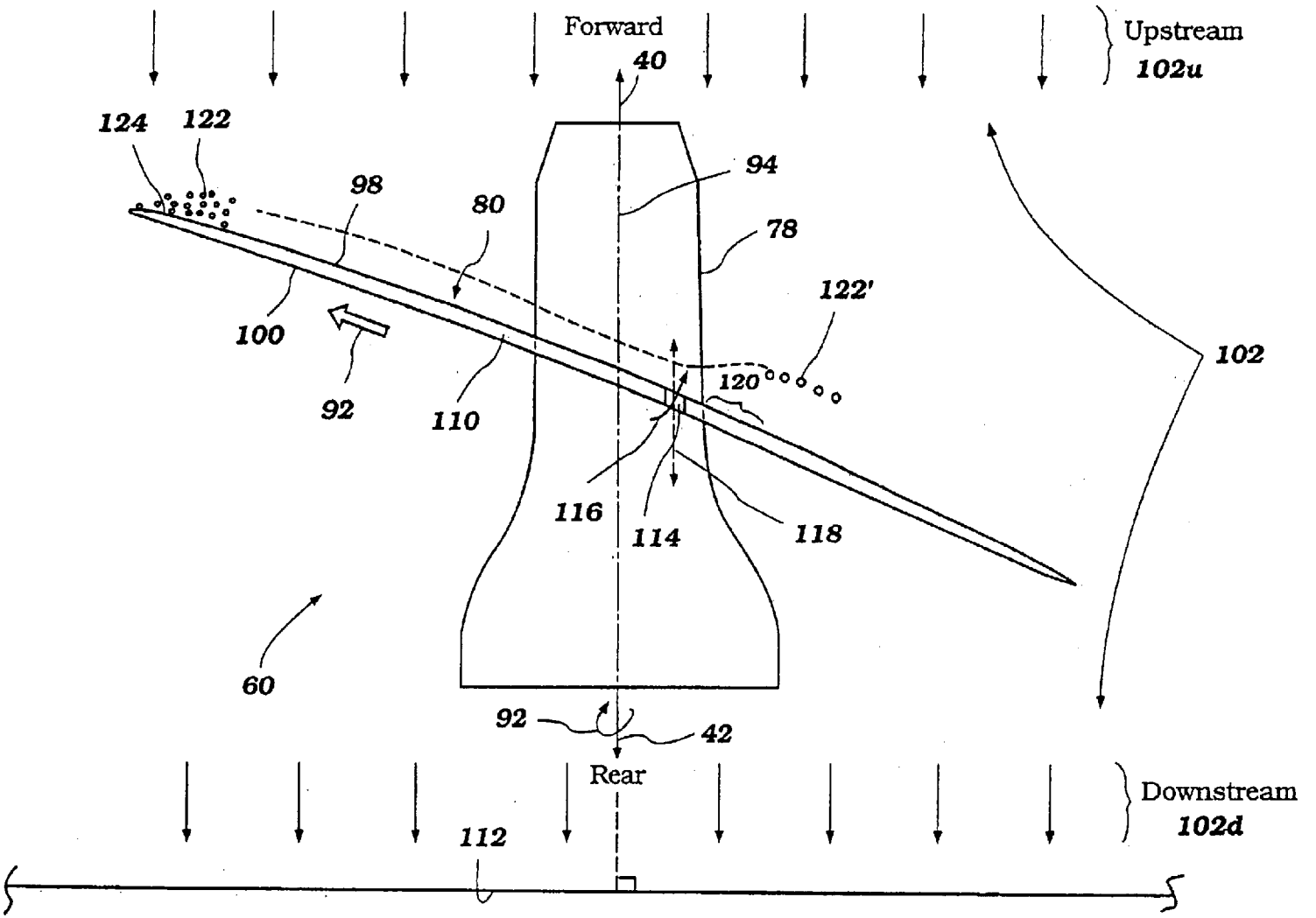
FIG. 6 is a side elevational view of the impeller of FIG. 3.

In the illustrated embodiment of FIGS. 3 to 6, each groove 116 is generally U-shaped and the projection of each groove 114 on the imaginary plane 112 (FIG. 6) perpendicular to the axis 94 is generally C-shaped, semi-circular or half-circular with a depth d and a width w, as shown in FIG. 5. In modified embodiments, other suitable groove shapes may be used with efficacy, as needed or desired, giving due consideration to the goal of generating a suitable back-flow.

In the illustrated embodiment of FIGS. 3 to 6, each groove 114 has a longitudinal axis 118, as shown in the side view of FIG. 6, which is substantially parallel to the impeller axis 94. In modified embodiments, and as discussed below in connection with FIG. 7, the groove axis can be unparallel to the impeller axis.

As known in the art, cavitation implies the formation of cavities or holes in a fluid being pumped or a flowing fluid. These holes are typically termed bubbles or vapors and form in regions where the fluid pressure is below the vapor pressure of the particular fluid, that is, the fluid "boils." For example, a sudden increase in the velocity of the pumped fluid can reduce the inlet fluid pressure below the vapor pressure and this results in cavitation or bubble precipitation in the liquid.

When a cavitation bubble flows to a region where the pressure is greater than the vapor pressure, it tries to collapse on itself or "implode." This implosion results in a release of energy. Thus, bubbles imploding on or near a solid surface can erode the surface, especially over time when repeated implosions occur.

The occurrence of cavitation and the location of cavitation induced erosion on an impeller depends on a number of factors. These can include the particular blade configuration, impeller speeds, flow speeds and the discharging characteristics, among others.

The present impeller provides a back-flow fluid channel on one or more of the impeller blades so that cavitation bubbles are swept away from the blade surface where they would otherwise have imploded and caused erosion. A discussion now follows, in reference to the illustrated embodiment of FIGS. 3–6, identifying particular zone(s) of potential cavitation induced erosion, discovered through laboratory testing, and which the back-flow fluid channel of the present impeller protects from erosion. It should be understood that, in modified embodiments, the present impeller can be configured to prevent erosion on other surfaces, for instance, as discussed below, in connection with FIGS. 8 and 9.

With reference to the illustrated embodiment of FIGS. 3 to 6, and in particular to FIGS. 5 and 6, a likely or potential cavitation induced erosion zone or region 120 is identified on the blade front face 98 and adjacent to the blade outer tip 110. For clarity, only a single blade 80 is shown in FIGS. 5 and 6, though the discussion applies equally to other blades.

Without the fluid channel 114, cavitation bubbles or vapors 122 (FIGS. 5 and 6) formed at or around a leading corner 124 of the low pressure blade side 98 could eventually, as the blade 60 rotates and the fluid flows, implode on the area 120. Of course, this particular scenario may happen only under certain operating conditions, such as, depending on particular impeller speeds, flow velocities and discharging characteristics, among others.

The groove 114 is preferably positioned forward of or leads, in the rotation direction 92, the zone 120 and allows back-flow 116 of water from the high pressure side 100 to the low pressure side 98. Advantageously, this back-flow directs the bubbles 122, travelling along the low pressure front side 98, away from the zone 120 as bubbles 122' and protects the zone 120 from erosion. Even if the swept away bubbles 122' implode and release energy, the effect of this on the blade face 98 is minimized, negligible or none, thereby limiting or substantially eliminating erosion.

With reference to FIGS. 3 to 6, and in particular to FIG. 5, the impeller 60 rotates within the outer housing 58 such that each blade tip 110 is spaced from an inner surface 126 of the housing 58 to form a small gap 128 therebetween. Preferably, the inner surface 126 is part of a wear ring 130 of the housing 58. The small gap 128 allows clearance space for the impeller blades 60 to rotate while also preventing any adverse back-flow (that is adverse in the sense of pump efficiency). The gap length or spacing between each blade tip 110 and the inner surface 126 is depicted as C in FIG. 5. In the exemplary embodiment, C is about 0.35 mm. Of course, as the skilled artisan will recognize, C can be varied to be greater or less, as needed or desired.

With reference in particular to FIGS. 5 and 6, the back-flow 116 through the groove 114 also prevents the bubbles 122 from imploding on the housing inner surface 126, which can be a likely erosion site otherwise, and hence inhibits erosion thereon. In the snapshot view (FIG. 5) of the rotating impeller 60, this erosion (without the channel 114) would occur at a zone or region 132 of the inner surface 126 which is proximate each trailing corner 134 of the blades 60. Of course, since the blades 60 rotate, the erosion is prevented on a generally circumferential or peripheral region of the inner surface 126 as followed by the blade corners 134.

Each groove or fluid channel 114 (FIGS. 3–6) is configured to have a size (that is, width w and depth d) that is large enough to provide sufficient back-flow 116 (FIG. 6) to sweep away the bubbles 122' and inhibit them from imploding or collapsing on the blade front surface 98. In addition, the groove size is selected to be suitably small so that the back-flow 116 is within a design tolerance level and has no or a negligible effect on the impeller performance and efficiency.

The optimal or most suitable size and location of each groove 114 (FIGS. 3 to 6) was determined through extensive research. The preferred size of the groove 114 is related to the gap size C (FIG. 5) and the outer or external major diameter D (FIGS. 4 and 5) of the impeller 60. There is also a design correlation between the gap size C and the impeller diameter D.

In the exemplary (i.e., illustrative) embodiment, the impeller diameter D (FIGS. 4 and 5) is about 15 cm. Of course, as the skilled artisan will recognize, D can be varied to be greater or less, as needed or desired. An impeller radius R can also be defined as the spacing or distance between the axis 94 and the outer rim 110, as shown in FIGS. 4 and 5. In the exemplary embodiment, this radius R is about 7.5 cm.

With reference in particular to FIG. 5, preferably the groove width w and depth d are each in the range from about the same as the gap size C to about twenty times the gap size C; more preferably are in the range for about the same as the gap size C to about twice the gap size C; and most preferably are both about equal to the gap size C. Thus, in an exemplary embodiment, wherein C is about 0.35 mm and the impeller 60 has the exemplary diameter and radius noted above, the groove width w and depth d preferably are each in the range from about 0.35 mm to about 7 mm; more preferably are each in the range from about 0.35 mm to about 0.7 mm; and most preferably are about 0.35 mm.

With reference still particularly to FIG. 5, preferably, the groove width w and depth d are each in the range from about 0.23% of the impeller diameter D to about 5% of the impeller diameter D; for the exemplary embodiment, wherein D is about 15 cm, the groove width w and depth d are each in the range from about 0.35 mm to about 7.5 mm. Preferably, the groove width w and depth d are each in the range from about 0.46% of the impeller radius R to about 10% of the impeller radius R; for the exemplary embodiment, wherein R is about 7.5 cm, the groove width w and depth d are each in the range from about 0.35 mm to about 7.5 mm.

Each groove or fluid channel 114 (FIGS. 3–6) is positioned on each respective rim 110 such that the bubbles 122' that are swept away by the water back-flow 116 are unlikely to implode at any trailing locations, with respect to the likely erosion site 120, on the blade surface 98.

With reference in particular to FIG. 5, the preferred location of the groove 114 is related to the spacing between the groove 114 and the likely erosion site 120. The groove 114 is positioned forward of or leads, in the rotation direction 92, a leading border or point 136 of the likely erosion site 120. The spacing or distance, along the outer rim 110, between the leading border 136 and a leading edge 138 of the outer rim 110 is generally denoted as E herein. In the illustrated embodiment, the groove 114 is substantially proximate or adjacent to the erosion site leading border 136.

With particular reference to FIG. 5, preferably, the groove 114 is positioned on the outer rim 110 within a 50% range extending from the likely erosion site border 136 towards the leading edge 138. Stated differently, the distance along the outer rim 110 between the groove 114 and the erosion site border 136 is in the range from about 0% of the distance E to about 50% of the distance E. More preferably, the groove 114 is positioned on the outer rim 110 within a 30% range extending from the likely erosion site border 136 towards the leading edge 138. Stated differently, the distance along the outer rim 110 between the groove 114 and the erosion site border 136 is in the range from about 0% of the distance E to about 30% of the distance E.

Figure 7:
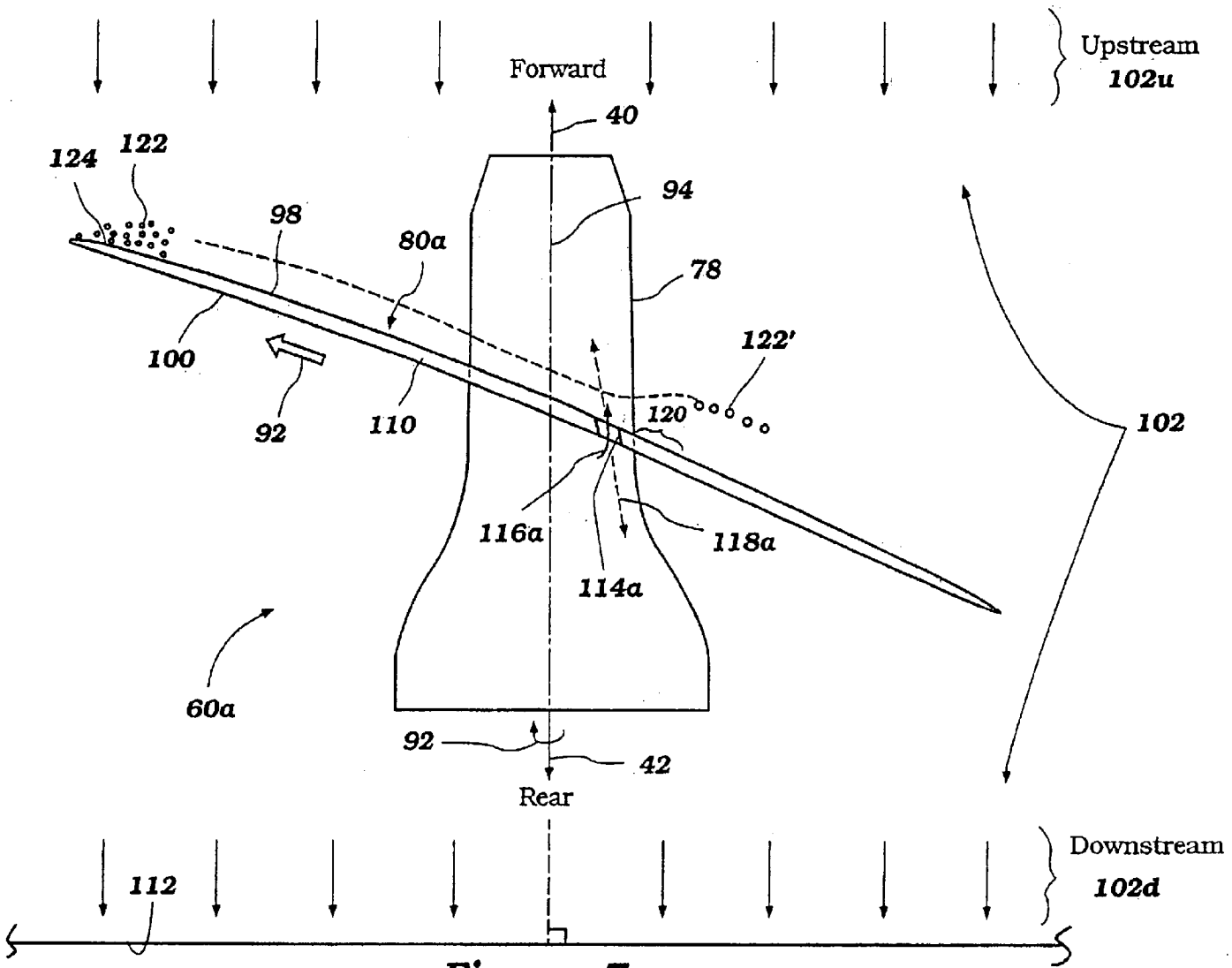
FIG. 7 is a side elevational partial view of an impeller configured in accordance with another preferred embodiment of the invention.

FIG. 7 shows an impeller 60*a* configured in accordance with a modified embodiment. For clarity, only a single blade 80*a* is shown. The blade 80*a* has a groove 114*a* which has a longitudinal axis 118*a* and allows a water back-flow 116*a*. The embodiment of FIG. 7 is substantially the same as that of FIGS. 3 to 6, except that the groove 114*a* is configured such that its longitudinal axis 118*a*, as shown in the side view of FIG. 7, is not parallel, i.e., is angled, relative to the impeller axis 94.

Figure 8:
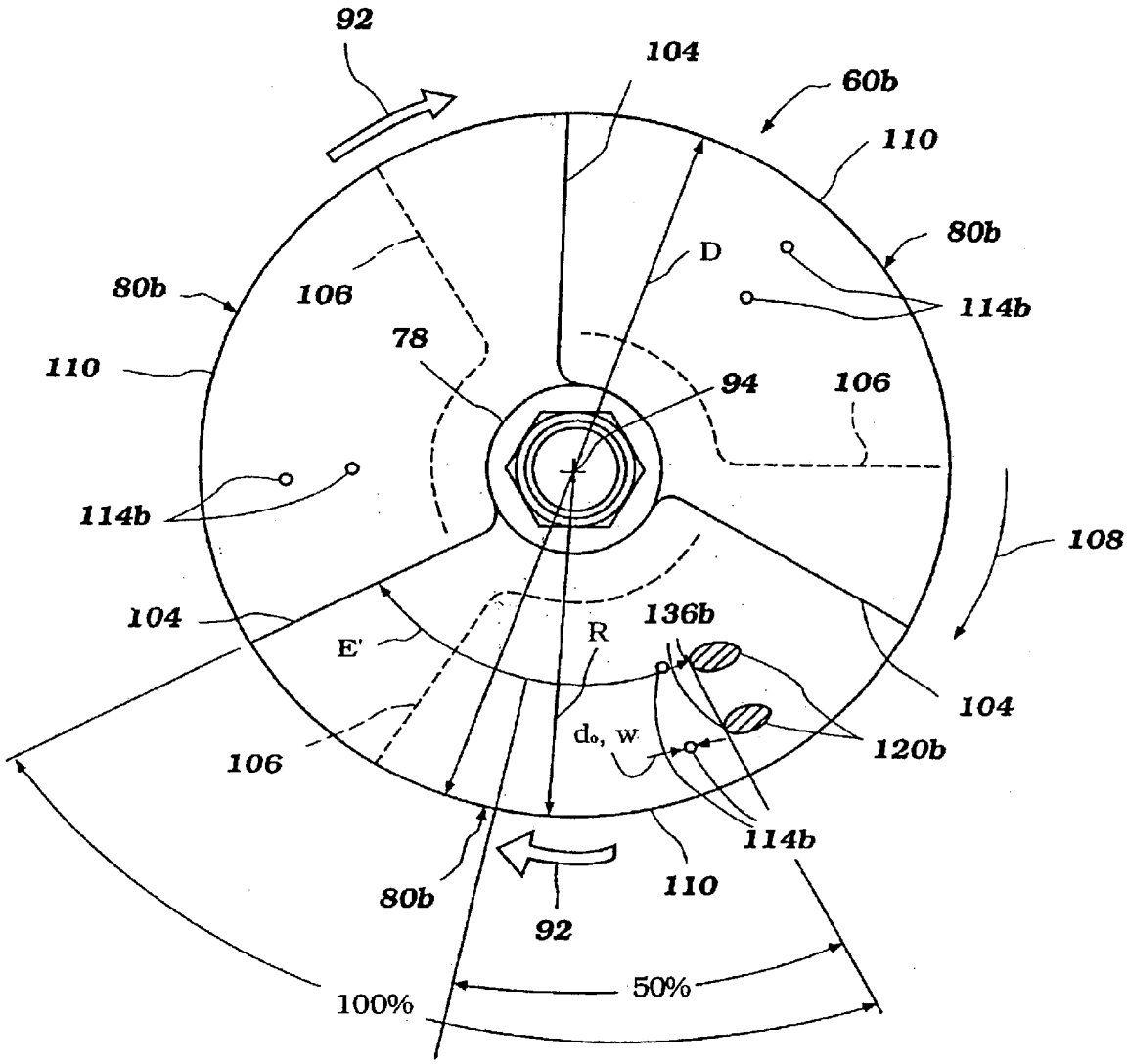
FIG. 8 is a front elevational view of an impeller configured in accordance with yet another preferred embodiment of the invention.

FIG. 8 shows an impeller 60*b* configured in accordance with another preferred embodiment of the invention. The embodiment of FIG. 8 is substantially similar to that of FIGS. 3 to 6, except that the back-flow fluid channels comprise one or more through holes, openings or passages 114*b* formed on each blade 80*b*. The back-flow through holes 114*b* are positioned at predetermined positions between respective blades rims 110 and the hub 78. While the illustrated embodiment describe and illustrates the openings as circular holes, it is understood that these opening or holes can have other configurations (such as, for example, but without limitation, elliptical or rectangular shapes) as well.

The holes 114*b* (FIG. 8) function in a manner similar to the grooves 114 (FIGS. 3–6) and permit a back-flow of water to sweep away bubbles and inhibit them from imploding on the impeller blades 80*b* and the inner surface of the outer housing 58 (as discussed above in connection with FIG. 5). In the illustrated embodiment of FIG. 8, two likely erosion sites 120*b* are identified on one of the blades 80*b*. Each erosion site 120*b* has a leading border 136*b*.

With reference to FIG. 8, preferably, each through hole 114*b* has a diameter $d_o$ or width w about the same as the gap size C (as shown in FIG. 5); for the exemplary embodiment, wherein C is about 0.35 mm, the hole diameter $d_o$ or width w is about 0.35 mm. Preferably, the hole diameter $d_o$ or width w is in the range from about the same as the gap size C to about twenty times the gap size C; for the exemplary embodiment, wherein C is about 0.35 mm, the hole diameter $d_o$ or width w is in the range from about 0.35 mm to about 7 mm.

With reference still to FIG. 8, preferably, the hole diameter $d_o$ or width w is in the range from about 0.23% of the impeller diameter D to about 5% of the impeller diameter D; for the exemplary embodiment, wherein D is about 15 cm, the hole diameter $d_o$ or width w is in the range from about 0.35 mm to about 7.5 mm. Preferably, the hole diameter $d_o$ or width w is in the range from about 0.46% of the impeller radius R to about 10% of the impeller radius R; for the exemplary embodiment, wherein R is about 7.5 cm, the hole diameter $d_o$ or width w is in the range from about 0.35 mm to about 7.5 mm.

With reference to FIG. 8, the preferred location of each through hole 114*b* is related to the spacing between the hole 114*b* and the associated likely erosion site 120*b*, and to the radial distance of the hole 114*b* from the axis 94. Each hole 114*b* is positioned forward of or leads, in the rotation direction 92, the associated leading border or point 136*b*. The circularly arcuate spacing or distance between the leading border 136*b* and the leading rim 104 is generally denoted as E' herein.

With reference still to FIG. 8, preferably, each hole 114*b* is positioned within a 50% range extending from the associated likely erosion site border 136*b* towards the associated leading rim 104. Stated differently, the circularly arcuate between each hole 114*b* and the associated erosion site border 136*b* is in the range from about 0% of the distance E' to about 50% of the distance E'.

Figure 9:
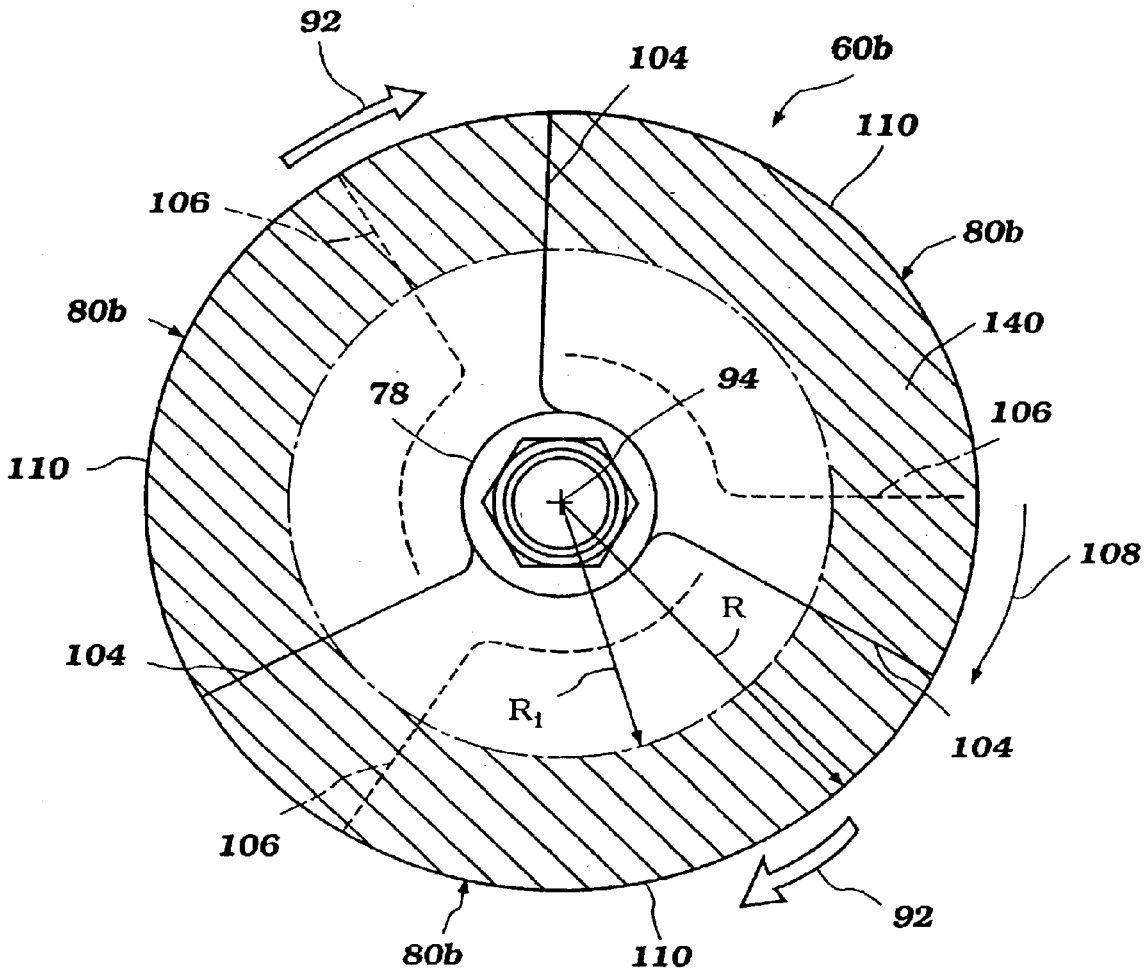
FIG. 9 is a front elevational view of the impeller of FIG. 8 illustrating one preferred region for placement of through holes.

Though the through holes 114*b* (FIG. 8) can be placed at any desired radially extending location on the blades 80*b*, preferably, they are positioned within an outer area 140, as illustrated in FIG. 9 by the shaded area. This area 140 has an outer radius about the same as the impeller radius R and an inner radius $R_i$. Preferably, $R_i$ is in the range from about 50% of the impeller radius R to about 70% of the impeller radius R.

In many cases, and with reference in particular to FIGS. 8 and 9, the pressure differential across the front and rear faces of each impeller blade 80*b* is greater in a direction extending away from the hub 78 and towards the outer rims 110. Thus, to generate the same amount of water back-flow, the through holes 114*b* can have a smaller size when positioned in the outer area 140 compared to being placed closer to the hub 78. These smaller through holes 114*b* are advantageous in maintaining the structural integrity of the blades 80*b*.

The through holes 114*b* (FIG. 8) can be oriented, relative to the axis 94, in a number of ways with efficacy, as needed or desired. Preferably, the holes 114*b* have a longitudinal axis that is not parallel, i.e., is angled, relative to the axis 94, similar to as described above in connection with the groove 114*a* of FIG. 7. The holes 114*b* may be oriented to create a back-flow in a direction towards or away from the hub 78 and/or towards or away from the each associated leading rim 104, as needed or desired. However, the holes can have a longitudinal axis that is parallel to central axis 94.

The utility of the back-flow providing channels of the present impeller will be readily apparent to those of ordinary skill in the art. This back-flow sweeps away cavitation bubbles and inhibits their implosion on surfaces of the impeller and its associated housing. One or more back-flow grooves 114, 114*a* (FIGS. 3–7) and/or one or more through holes 114*b* (FIG. 8) may efficaciously be provides in various permutations and combinations on one or more impeller blades, as required or desired, giving due consideration to the goals of preventing cavitation induced erosion, and/or of achieving one or more of the benefits and advantages as disclosed, taught or suggested herein.

Although the present impeller has been described in conjunction with a small watercraft, it is to be understood that the present impeller may be utilized in conjunction with a variety of applications for vehicles or other devices powered by either jet propulsion device or other devices embodying an impeller. The present impeller has particular utility, however, in ducted impeller applications although it is not limited to such applications.

While the components and techniques of the present invention have been described with a certain degree of particularity, it should be understood that many changes may be made in the specific designs, constructions and methodology hereinabove described without departing from the spirit and scope of this disclosure. It also should be understood that the invention is not limited to the embodiments set forth herein for purposes of exemplification, but is to be defined only by a fair reading of the appended claims, including the full range of equivalency to which each element thereof is entitled.

What is claimed is:

1. An impeller for a marine propulsion device, comprising a generally central hub having a generally central axis, the hub being adapted to rotate about the axis, at least one blade connected to the hub and extending generally outwardly therefrom, the blade comprising a leading surface facing generally upstream, a trailing surface facing generally downstream and an outer rim, and a groove formed on the outer rim of the blade, the outer rim having a leading edge and the groove being disposed on the blade to inhibit erosion on a zone of the leading surface adjacent the outer rim and spaced from the leading edge of the outer rim by a distance E along the outer rim.

2. The impeller of claim 1, wherein the groove is formed at a predetermined location at the outer rim of the blade so as to allow fluid to back-flow from downstream to upstream to inhibit cavitation induced bubbles from imploding on the leading surface of the blade.

3. The impeller of claim 1 in combination with a jet propulsion unit, wherein the impeller is enclosed in a housing of the jet propulsion unit, the housing has an inner surface, and a gap is defined between the outer rim of the blade and the inner surface of the housing, the gap being equal to a distance C.

4. The jet propulsion unit of claim 3, wherein the projection of the groove on a plane substantially perpendicular to the axis of the hub has a depth d about equal to the distance C.

5. The jet propulsion unit of claim 3, wherein the projection of the groove on a plane substantially perpendicular to the axis of the hub has a depth d in the range from about the same as the distance C to about twenty times the distance C.

6. The jet propulsion unit of claim 3, wherein the groove has a width w about the same as the distance C.

7. The jet propulsion unit of claim 3, wherein the groove has a width w in the range from equal to about the distance C to about twenty times the distance C.

8. The impeller of claim 1, wherein the outer rim of the blade is spaced from the axis of the hub by a distance R and the projection of the groove on a plane substantially perpendicular to the axis of the hub has a depth d in the range from about 0.46% of the distance R to about 10% of the distance R.

9. The impeller of claim 1, wherein the outer rim of the blade is spaced from the axis of the hub by a distance R and the groove has a width w in the range from about 0.46% of the distance R to about 10% of the distance R.

10. The impeller of claim 1, wherein the groove is positioned substantially adjacent to the zone of the leading surface.

11. The impeller of claim 10, wherein the impeller has a direction of rotation and the groove is positioned forward of the zone of the leading surface relative to the direction of rotation.

12. The impeller of claim 1, wherein the impeller has a direction of rotation and the groove is positioned forward of the zone of the leading surface relative to the direction of rotation.

13. The impeller of claim 12, wherein the groove is spaced from the zone of the leading surface by a distance G along the outer rim which is in the range from about 0% of the distance E to about 50% of the distance E.

14. The impeller of claim 12, wherein the groove is spaced from the zone of the leading surface by a distance G along the outer rim which is in the range from about 0% of the distance E to about 30% of the distance E.

15. The impeller of claim 1, wherein the groove has a generally longitudinal axis which is substantially parallel to the axis of the hub.

16. The impeller of claim 1, wherein the groove has a generally longitudinal axis which is angled with respect to the axis of the hub.

17. The impeller of claim 1, wherein the groove is generally semi-circular.

18. The impeller of claim 1 in combination with a jet propulsion device of a watercraft, the jet propulsion device including a housing surrounding the impeller, an intake duct communicating with the housing, and an impeller shaft driving the impeller.

19. The watercraft as in claim 18, wherein the watercraft includes a hull, and at least a part of the intake duct is defined by a portion of the hull.

20. An impeller for a watercraft comprising:

a boss portion being rotatable about a generally central axis of the impeller;

at least one blade coupled to the boss portion and extending generally outwardly therefrom, the blade comprising an upstream side and a downstream side; and a through hole on the blade between the upstream side and the downstream side, the through hole having a generally longitudinal axis which is substantially parallel to the central axis of the impeller.

21. The impeller of claim 20, wherein the hole is sized and arranged to permit high pressure water from the downstream side to flow through the hole towards low pressure water on the upstream side for sweeping water vapor away from the upstream side.

22. The impeller of claim 21, wherein the impeller has an outer rim that is spaced from the central axis of the impeller by a distance R and the through hole has a generally circular shape with a diameter $d_o$ or width w in the range from about 0.46% of the distance R to about 10% of the distance R.

23. The impeller of claim 20 in combination with an impeller housing, wherein the impeller is enclosed in the housing, the housing has an inner surface, and the blade has an outer rim, the outer rim being spaced from the inner surface by a gap of distance C.

24. The impeller of claim 23, wherein the through hole has a generally circular shape of a diameter $d_o$ or width w that is about the same as the distance C.

25. The impeller of claim 23, wherein the through hole has a generally circular shape of a diameter $d_o$ or width w in the range from about the same as the distance C to about twenty times the distance C.

26. The impeller of claim 20, wherein the impeller has an external diameter D and the through hole has a generally circular shape with a diameter $d_o$ or width w in the range from about 0.23% of the diameter D to about 5% of the diameter D.

27. The impeller of claim 20, wherein the blade has a leading rim and the through hole is located to inhibit erosion on a zone of the upstream side spaced from the leading rim by a distance E', the through hole being spaced from the zone of the upstream side by a distance G which is in the range from about 0% of the distance E' to about 50% of the distance E'.

28. The impeller of claim 27, wherein the through hole is positioned substantially adjacent to the zone of the upstream side.

29. The impeller of claim 27, wherein the impeller has a direction of rotation and the through hole is positioned forward of the zone of the upstream side relative to the direction of rotation.

30. The impeller of claim 20, wherein the blade has a leading rim and the through hole is located to inhibit erosion on a zone of the upstream side that is spaced from the leading rim, and wherein the impeller has a direction of rotation and the through hole is positioned forward of the zone relative to the direction of rotation.

31. The impeller of claim 20, wherein the impeller comprises another through hole has a generally longitudinal axis which is angled with respect to the central axis of the impeller.

32. An impeller for a marine propulsion device, comprising:

a generally central hub;

at least one blade extending generally outwards from the hub and comprising a front surface and a back surface;

a fluid channel on the blade to allow back-flow driven by a pressure differential between the front surface and the back surface for preventing cavitation induced erosion; and an outer rim including a leading edge and the fluid channel being disposed on the blade to inhibit erosion on a zone of the leading surface adjacent the outer rim and spaced from the leading edge of the outer rim by a distance E along the outer rim.

33. The impeller of claim 32, wherein the blade has an outer rim and the fluid channel comprises a groove on the outer rim.

34. The impeller of claim 32, wherein the fluid channel comprises a through passage between the front surface and the back surface.

35. The impeller of claim 32 in combination with a jet propulsion unit, wherein the blade has an outer rim and the impeller is enclosed in a housing of the jet propulsion unit, the housing having an inner surface spaced from the outer rim of the blade to form a gap therebetween which spaces the inner surface of the housing and the outer rim of the blade by a distance C.

36. The impeller of claim 35, wherein the impeller has a rotation axis and the projection of the fluid channel on a plane substantially perpendicular to the rotation axis has a depth d about the same as the distance C.

37. The impeller of claim 35, wherein the impeller has a rotation axis and the projection of the fluid channel on a plane substantially perpendicular to the rotation axis has a depth d in the range from about the same as the distance C to about twenty times the distance C.

38. The impeller of claim 35, wherein the fluid channel has a diameter $d_o$ or width w about the same as the distance C.

39. The impeller of claim 35, wherein the fluid channel has a diameter $d_o$ or width w in the range from about the same as the distance C to about twenty times the distance C.

40. The impeller of claim 32, wherein the impeller has a rotation axis and an external diameter D and the projection of the fluid channel on a plane substantially perpendicular to the rotation axis has a depth d in the range from about 0.23% of the diameter D to about 5% of the diameter D.

41. The impeller of claim 32, wherein the impeller has an external diameter D and the fluid channel has a diameter $d_o$ or width w in the range from about 0.23% of the diameter D to about 5% of the diameter D.

42. The impeller of claim 32, wherein the fluid channel is positioned substantially adjacent to the zone of the leading surface.

43. The impeller of claim 42, wherein the impeller has a direction of rotation and the fluid channel is positioned forward of the zone of the leading surface relative to the direction of rotation.

44. The impeller of claim 32, wherein the impeller has a direction of rotation and the fluid channel is positioned forward of the zone of the leading surface relative to the direction of rotation.

45. The impeller of claim 32, wherein the fluid channel is spaced from the zone of the leading surface by a distance G along the outer rim which is in the range from about 0% of the distance E to about 50% of the distance E.

46. The impeller of claim 32, wherein the fluid channel is spaced from the zone of the leading surface by a distance G along the outer rim which is in the range from about 0% of the distance E to about 30% of the distance E.

47. The impeller of claim 32, wherein the fluid channel has a generally longitudinal axis which is substantially parallel to the axis of the hub.

48. The impeller of claim 32, wherein the fluid channel has a generally longitudinal axis which is angled with respect to the axis of the hub.

49. The impeller of claim 32 in combination with a jet propulsion device of a watercraft, the jet propulsion device including a housing surrounding the impeller, an intake duct communicating with the housing, and an impeller shaft driving the impeller.

50. The watercraft as in claim 49, wherein the watercraft includes a hull, and at least a part of the intake duct is defined by a portion of the hull.

51. An impeller for a marine propulsion device, comprising a generally central hub having a generally central axis, the hub being adapted to rotate about the axis, at least one blade connected to the hub and extending generally outwardly therefrom, the blade comprising a leading surface facing generally upstream, a trailing surface facing generally downstream and an outer rim, and groove formed on the outer rim of the blade, the groove having a generally longitudinal axis which is substantially parallel to the axis of the hub.

52. The impeller of claim 51, wherein the groove is formed at a predetermined location at the outer rim of the blade so as to allow fluid to back-flow from downstream to upstream to inhibit cavitation induced bubbles from imploding on the leading surface of the blade.

53. The impeller of claim 51 in combination with a jet propulsion unit, wherein the impeller is enclosed in a housing of the jet propulsion unit, the housing has an inner surface, and a gap is defined between the outer rim of the blade and the inner surface of the housing, the gap being equal to a distance C.

54. The jet propulsion unit of claim 53, wherein the projection of the groove on a plane substantially perpendicular to the axis of the hub has a depth d about equal to the distance C.

55. The jet propulsion unit of claim 53, wherein the projection of the groove on a plane substantially perpendicular to the axis of the hub has a depth d in the range from about the same as the distance C to about twenty times the distance C.

56. The jet propulsion unit of claim 53, wherein the groove has width w about the same as the distance C.

57. The jet propulsion unit of claim 53, wherein the groove has a width w in the range from equal to about the distance C to about twenty times the distance C.

58. The impeller of claim 51, wherein the outer rim of the blade is spaced from the axis of the hub by a distance R and the projection of the groove on plane substantially perpendicular to the axis of the hub has a depth d in the range from about 0.46% of the distance R to about 10% of the distance R.

59. The impeller of claim 51, wherein the outer rim of the blade is spaced from the axis of the hub by a distance R and the groove has a width w in the range from about 0.46% of the distance R to about 10% of the distance R.

60. The impeller of claim 51, wherein the outer rim has a leading edge and the groove is disposed on the blade to inhibit erosion on a zone of the leading surface adjacent the outer rim and spaced from the leading edge of the outer rim by a distance E along the outer rim, and wherein the groove is positioned substantially adjacent to the zone of the leading surface.

61. The impeller of claim 60, wherein the impeller has a direction of rotation and the groove is positioned forward of the zone of the leading surface relative to the direction of rotation.

62. The impeller of claim 51, wherein the outer rim has a leading edge and the groove is disposed on the blade to inhibit erosion on a zone of the leading surface adjacent the outer rim and spaced from the leading edge of the outer rim by a distance E along the outer rim, and wherein the impeller has a direction of rotation and the groove is positioned forward of the zone of the heading surface relative to the direction of rotation.

63. The impeller of claim 62, wherein the groove is spaced from the zone of the leading surface by a distance G along the outer rim which is in the range from about 0% of the distance E to about 50% of the distance E.

64. The impeller of claim 62, wherein the groove is spaced from the zone of the leading surface by a distance G along the outer rim which is in the range from about 0% of the distance E to about 30% of the distance E.

65. The impeller of claim 51, wherein the impeller comprises another groove that has a generally longitudinal axis which is angled with respect to the axis of the hub.

66. The impeller of claim 51, wherein the groove is generally semi-circular.

67. The impeller of claim 51 in combination with a jet propulsion device of a watercraft, the jet propulsion device including a housing surrounding the impeller, and intake duct communicating with the housing, and an impeller shaft driving the impeller.

68. The watercraft as in claim 67, wherein the watercraft includes a hull, and at least a part of the intake duct is defined by a portion of the hull.

69. An impeller for a marine propulsion device, comprising:

a generally central hub;

at least one blade extending generally outwards from the hub and comprising a front surface and a back surface; and a fluid channel on the blade to allow back-flow driven by a pressure differential between the front surface and the back surface for preventing cavitation induced erosion, the fluid channel having a generally longitudinal axis which is substantially parallel to the axis of the hub.

70. The impeller of claim 69, wherein the blade has a outer rim and the fluid channel comprises a groove on the outer rim.

71. The impeller of claim 69, wherein the fluid channel comprises a through passage between the front surface and the back surface.

72. The impeller of claim 69, in combination with a jet propulsion unit wherein the blade has an outer rim and the impeller is enclosed in a housing of the jet propulsion unit, the housing having an inner surface spaced from the outer rim of the blade to form a gap therebetween which spaces the inner surface of the housing and the outer rim of the blade by a distance C.

73. The impeller of claim 72, wherein the impeller has rotation axis and the projection of the fluid channel on a plane substantially perpendicular to the rotation axis has a depth d about the same as the distance C.

74. The impeller of claim 72, wherein the impeller has rotation axis and the projection of the fluid channel on a plane substantially perpendicular to the rotation axis has a depth d about the same as the distance C to about twenty times the distance C.

75. The impeller of claim 72, wherein the fluid channel has a diameter $d_o$ or width w about the same as the distance C.

76. The impeller of claim 72, wherein the fluid channel has a diameter $d_o$ or width w about the same as the distance C to about twenty times the distance C.

77. The impeller of claim 69, wherein the impeller has a rotation axis and an external diameter D and the projection of the fluid channel on a plane substantially perpendicular to the rotation axis has a depth d in the range from about 0.23% of the diameter D to about 5% of the diameter D.

78. The impeller of claim 69, wherein the impeller has a external diameter D and the fluid channel has a diameter $d_o$ or width w in the range from about 0.23% of the diameter D to about 5% of the diameter D.

79. The impeller of claim 69, wherein the impeller has an outer rim including a leading edge and the fluid channel is disposed on the blade to inhibit erosion on a zone of the leading surface adjacent the outer rim and spaced from the leading edge of the outer rim by a distance E along the outer rim, and wherein the fluid channel is positioned substantially adjacent to the zone of the leading surface.

80. The impeller of claim 79, wherein the impeller has a direction of rotation and the fluid channel is positioned forward of the zone of the leading surface relative to the direction of rotation.

81. The impeller of claim 69, wherein the impeller has an outer rim including a leading edge and the fluid channel is disposed on the blade to inhibit erosion on a zone of the leading surface adjacent the outer rim and spaced from the leading edge of the outer rim by a distance E along the outer rim, and wherein the impeller has a direction of rotation and the fluid channel is positioned forward of the zone of the leading surface relative to the direction of rotation.

82. The impeller of claim 69, wherein the impeller has an outer rim including a leading edge and the fluid channel is disposed on the blade to inhibit erosion on a zone of the leading surface adjacent the outer rim and spaced from the leading edge of the outer rim by a distance E along the outer rim, and wherein the fluid channel is spaced from the zone of the leading surface by a distance G along the outer rim which is in the range from about 0% of the distance E to about 50% of the distance E.

83. The impeller of claim 69, wherein the impeller has an outer rim including a leading edge and the fluid channel is disposed on the blade to inhibit erosion on a zone of the leading surface adjacent the outer rim and spaced from the leading edge of the outer rim by a distance E along the outer rim, and wherein the fluid channel is spaced from the zone of the leading surface by a distance G along the outer rim which is in the range from about 0% of the distance E to about 30% of the distance E.

84. The impeller of claim 69, wherein the impeller comprises another fluid channel that has a generally longitudinal axis which is angled with respect to the axis of the hub.

85. The impeller of claim 69, in combination with a jet propulsion device of a watercraft, the propulsion device including a housing surrounding the impeller, and intake duct communicating with the housing, and an impeller shaft driving the impeller.

86. The watercraft as in claim 85, wherein the watercraft includes a hull, and at least part of the intake duct is defined by a portion of the hull.

* * * * *

UNITED STATES PATENT AND TRADEMARK OFFICE

CERTIFICATE OF CORRECTION

PATENT NO. : 6,857,919 B2
APPLICATION NO. : 09/957447
DATED : February 22, 2005
INVENTOR(S) : Yasuhiko Henmi et al.

It is certified that error appears in the above-identified patent and that said Letters Patent is hereby corrected as shown below:

At column 15, line 14, in Claim 31, after “hole” insert --that--.
At column 16, line 39, in Claim 51, after “and” insert --a--.
At column 16, line 64, in Claim 56, after “has” insert --a--.
At column 17, line 3, in Claim 58, after “on” insert --a--.
At column 17, line 28, in Claim 62, delete “heading” and insert --leading--, therefor.
At column 17, line 45 (Approx.), in Claim 67, delete “and” and insert --an--, therefor.
At column 17, line 62, in Claim 70, delete “a” and insert --an--, therefor.
At column 18, line 1, in Claim 72, delete “,” before “in”.
At column 18, line 2, in Claim 72, after “unit” insert --,--.
At column 18, line 8, in Claim 73, after “has” insert --a--.
At column 18, line 13 (Approx.) in Claim 74, after “has” insert --a--.
At column 18, line 15 (Approx.) in Claim 74, after “depth d” insert --in the range from--.
At column 18, line 22, in Claim 76, after “width w” insert --in the range from--.
At column 18, line 29 (Approx.) in Claim78, delete “a” and insert --an--, therefor.
At column 19, line 7 (Approx.) in Claim 85, delete “,” before “in”.
At column 19, line 8 (Approx.) in Claim 85, after “the” insert --jet--.
At column 20, line 1, in Claim 85, delete “and” and insert --an--, therefor.
At column 20, line 5, in Claim 86, after “at least” insert --a--.

Signed and Sealed this

Seventh Day of August, 2007

JON W. DUDAS
*Director of the United States Patent and Trademark Office*